FIP7912 XR 4,166,503

United States Patent [19]

Hall et al.

[11] 4,166,503

[45] Sep. 4, 1979

[54] HIGH VERTICAL CONFORMANCE STEAM DRIVE OIL RECOVERY METHOD

[75] Inventors: Wilbur L. Hall, Bellaire; Alfred Brown, Houston; Ralph J. Korstad, Austin, all of Tex.

[73] Assignee: Texaco Inc., White Plains, N.Y.

[21] Appl. No.: 936,559

[22] Filed: Aug. 24, 1978

[51] Int. Cl.[2] ..... E21B 43/24

[52] U.S. Cl. ..... 166/263; 166/245; 166/272; 166/274

[58] Field of Search ..... 166/263, 272, 274, 245

[56] References Cited

U.S. PATENT DOCUMENTS

| | | | |
|---|---|---|---|
| 2,862,558 | 12/1958 | Dixon | 166/272 |
| 3,042,114 | 7/1962 | Willman | 166/272 |
| 3,129,758 | 4/1964 | Closmann | 166/272 X |
| 3,252,512 | 5/1966 | Baker et al. | 166/263 |
| 3,412,794 | 11/1968 | Craighead | 166/272 |
| 3,472,318 | 10/1969 | Woodward | 166/263 X |
| 3,672,448 | 6/1972 | Hoyt | 166/245 |
| 3,834,461 | 9/1974 | Carlin et al. | 166/245 |
| 3,903,966 | 9/1975 | Teasdale et al. | 166/245 |
| 3,946,810 | 3/1976 | Barry | 166/272 |
| 4,088,188 | 5/1970 | Widmyer | 166/269 |

*Primary Examiner*—Stephen J. Novosad
*Attorney, Agent, or Firm*—Carl G. Ries; Thomas H. Whaley; Jack H. Park

[57] ABSTRACT

The vertical conformance of a steam drive process is improved and steam override reduced by penetrating the recovery zone between one injection well and one producing well, with at least one infill well which is in fluid communication with no more than the bottom half of the formation. Steam or a mixture of steam and hydrocarbon is injected into the injection well and fluids including oil are recovered from the producing well until live steam production occurs at the producing well. Petroleum production is then begun at the infill well and continued until the water cut of the fluids being produced from the infill well reaches 95 percent. The infill well is converted from a producer to an injector and hot water or cold water followed by hot water is injected into thelower portion of the formation via the infill well and fluids are produced from the production well. By this means, oil is recovered from the lower portions of the formation between the infill well and the production well. After water breakthrough occurs at the production well, steam is injected into the infill well and fluids are recovered from the production well. Hydrocarbon solvent is injected either as a slug prior to steam injection into the infill well or comingled with the steam being injected into the infill well. By this multistep process involving the infill well, the amount of oil recovered from the portion of the formation in the recovery zone defined by the injection and production well is increased significantly.

21 Claims, 7 Drawing Figures

HIGH VERTICAL CONFORMANCE STEAM DRIVE OIL RECOVERY METHOD

FIELD OF THE INVENTION

The present invention concerns a steam throughput or steam drive oil recovery method. More particularly, the present invention involves a steam drive oil recovery method especially suitable for use in relatively thick, viscous oil-containing formations, by means of which viscous oil may be recovered from the formation without experiencing poor vertical conformance caused by steam channeling and overriding which reduces the amount of oil recovered from the formation.

BACKGROUND OF THE INVENTION

It is well recognized by persons skilled in the art of oil recovery that there are formations which contain petroleum whose viscosity is so great that little or no primary production is possible. Some form of supplemental or enhanced oil recovery must be applied to these formations in order to decrease the viscosity of the petroleum sufficiently that it will flow or can be displaced through the formation to production wells and then through to the surface of the earth. Thermal recovery techniques are quite effective for application to viscous oil formations, and steam flooding is the most successful thermal oil recovery technique yet employed in commercial application. Steam has been utilized for thermal stimulation for viscous oil formations by means of a "huff and puff" technique in which steam is injected into a well, allowed to remain in the formation for a soak period, and then oil is recovered from the formation by means of the same well as was used for steam injection. Another technique employing steam stimulation is a steam drive or steam throughput process, in which steam is injected into the formation on a more or less continuous basis by means of an injection well and oil is recovered from the formation from a spaced-apart production well. This technique is somewhat more effective in many applications than the "huff and puff" steam stimulation process since it both reduces the viscosity of the petroleum and displaces petroleum through the formation, thus encouraging production from a production well. While this process is very effective with respect to the portions of the recovery zone between the injection well and production well through which the steam travels, poor vertical conformance is often experienced in steam drive oil recovery processes. A major cause of poor vertical conformance is associated with the fact that steam, being of lower density than other fluids present in the permeable formation, migrates to the upper portion of the permeable formation and channels across the top of the oil formation to the remotely located production well. Once steam channeling has occurred in the upper portion of the formation, the permeability of the steam-swept zone is increased due to the desaturation or removal of petroleum from the portions of the formation through which steam has channeled. Thus subsequently-injected steam will migrate almost exclusively through the steam-swept channel and very little of the injected steam will move into the lower portions of the formation, and thus very little additional petroleum will be recovered from the lower portions of the formation. While steam drive processes effectively reduce the oil saturation in the portion of the formation through which steam travels by a significant amount, a portion of the recovery zone between the injection and production systems actually contacted by steam if often less than 50 percent of the total volume of that recovery zone, and so a significant amount of oil remains in the formation after completion of the steam drive oil recovery process. The severity of the poor vertical conformance problem increases with the thickness of the oil formation and with the viscosity of the petroleum contained in the oil formation.

In view of the foregoing discussion, and the large deposits of viscous petroleum from which only a small portion can be recovered because of the poor conformance problem, it can be appreciated that there is a serious need for an improved, high vertical conformance steam drive thermal oil recovery method suitable for use in recovering viscous petroleum, especially for use in relatively thick formations.

SUMMARY OF THE INVENTION

The process of our invention involves a multi-step process involving at least one injection well and at least one production well for injecting steam into the formation and recovering petroleum from the formation as is done in the current practice of state-of-the-art steam drive oil recovery processes. At least one additional well, referred to herein as an infill well, is drilled into the formation and fluid communication between the well and the formation is established with only the lower 50 percent and preferably the lower 25 percent of the viscous oil formation. This well may be completed at the same time the primary injection well and production well are completed, or it may be completed in the formation when it is needed. The infill well or wells is located generally between the injection and production well, within the recovery zone, e.g., that portion of the formation through which steam passes with respect to at least a portion of the vertical thickness of the formation. The infill well may be on a line between the injector and producer or offset therefrom. The distance from the injector to the infill well should be from 25 to 75 and preferably from 40 to 60 percent of the distance from the injector to the producer. Steam is injected into the injection well and petroleum is recovered from the production well as is conventionally practiced in the art until steam breakthrough at the production well occurs. In one embodiment of the process of our invention, hydrocarbon is comingled with steam or injected separately in one or more slugs simultaneously or sequentially with steam injection. At this time, as little as 50 percent or less of the formation will have been swept by steam due to steam channeling through the upper portions of the formation. At this point, production of petroleum is taken from the infill well while continuing injecting steam into the injection well, which recovers oil from the lower portion of the formation between the primary injection well and the infill well. This step is continued until the fluid being recovered from the infill well reaches about 95 percent water (referred to in the art as 95 percent water cut). At this point, the infill well is converted from production well service to injection well service. In one preferred embodiment of our process, hot water is then injected into the infill well. Because the specific gravity of the hot water is greater than the specific gravity of steam, and about equal to or greater than the specific gravity of the viscous oil present in the unswept portion of a formation, the hot liquid phase water passes into and through the lower portion of the formation, and displaces oil therefrom toward the production well. This results in recovering viscous petroleum from the lower portion of that portion of the recovery zone between the infill well and the production well, which would ordinarily not be swept by steam. Once the water cut of the fluid being produced from the production well reaches a value of about 95 percent, injection of hot water into the infill well is terminated and steam injection into the infill well is begun. Hydrocarbon solvent is either comingled with steam being injected into the infill well or injected separately in one or more slugs sequentially or simultaneously with steam. In either of the foregoing embodiments employing hydrocarbon injections, the hydrocarbon may be a $C_1$ to $C_{12}$ and preferably $C_3$ to $C_7$ hydrocarbon, including mixtures thereof. Commercial mixtures such as naphtha, natural gasoline, kerosene, etc. may also be used. Condensed hydrocarbons obtained from the vapor phase of production wells in a steam drive process, especially one being conducted in the same formation, is an especially preferred embodiment. During the period when the infill well is used for fluid production, steam injection into the original injection well is continued and fluid production from the original production well is optional also continued. During the period when the infill well is used for fluid injection, fluid injection into the injection well is continued and fluid production via the production well is continued. Steam injection into the infill well continues until live steam production at the production well occurs.

DESCRIPTION OF THE PREFERRED EMBODIMENTS

Figure 1:
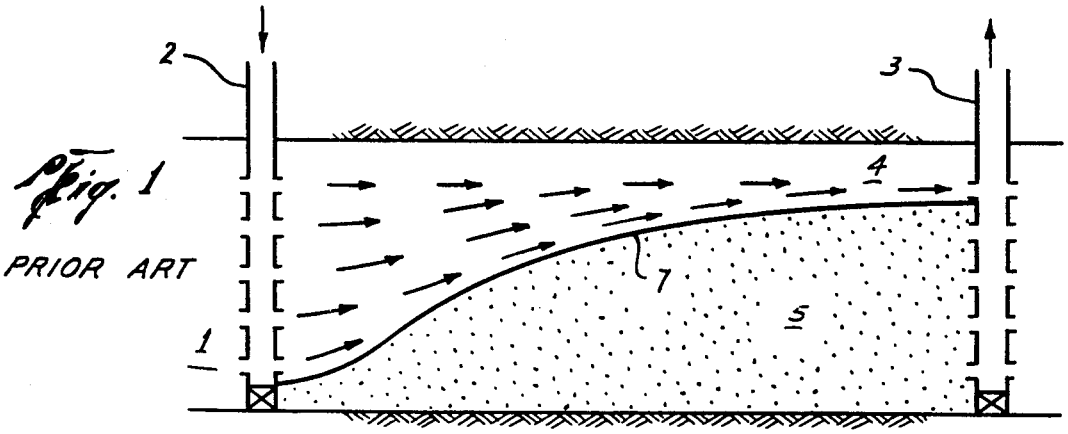
Fig. 1 PRIOR ART
FIG. 1 illustrates a subterranean formation penetrated by an injection well and a production well being employed in a state-of-the-art steam drive oil recovery method, illustrating how the injected steam migrates to the upper portions of the formation as it travels through the recovery zone within the formation and between the injection well and production well, thus overriding and bypassing a significant amount of petroleum in the recovery zone.

The problem of steam override may best be understood by referring to FIG. 1 which illustrates how a relatively thick, viscous oil formation 1 penetrated by an injection well 2 and a production well 3 is used for a conventional steam drive oil recovery process. Steam is injected into well 2, passes through the perforations in well 2 into the viscous oil formation. Conventional practice is to perforate or establish fluid flow communications between the well and the formation throughout the full vertical thickness of the formation, both with respect to injection well 2 and production well 3. Notwithstanding the fact that steam is injected into the full vertical thickness of the formation, it can be seen that steam migrates both horizontally and in an upward direction as it moves through the formation between injection well 2 and production well 3. The result is the creation of a steam-swept zone 4 in the upper portion of the formation and zone 5 in the lower portion of the formation through which little or no steam has passed. Once steam breakthrough at production well 3 occurs, continued injection of steam will not cause significant flow of steam through or recovery of oil from section 5, because (1) the specific gravity of the substantially all vapor-phase steam is significantly less than the specific gravity of the petroleum and other liquids present in the pore spaces of the formation, and so gravitational effects will cause the steam vapors to be confined exclusively in the upper portion of the formation, and (2) steam passage through the upper portion of the formation displaces and removes petroleum from that portion of the formation through which it travels, and desaturation of the zone increases the relative permeability of the formation significantly as a consequence of removing the viscous petroleum therefrom. Thus any injected fluid will travel more readily through the desaturated or swept portion of the formation 4 than it will through the portion of the formation 5 which is near original conditions with respect to viscous petroleum saturation.

Figure 2:
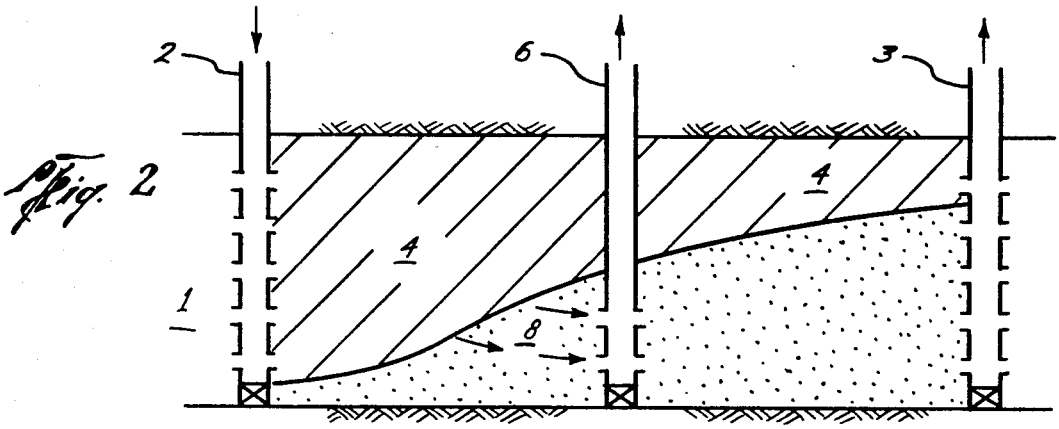
FIG. 2 illustrates the location of the infill well and its use in the first phase of our process in which fluids are recovered from the formation by means of the infill well.

FIG. 2 illustrates how infill well 6 is drilled into the formation, with respect to injection well 2 and production well 3. Infill well 6 must be drilled into the recovery zone within the formation defined by injection well 2 and production well 3. It is not essential that infill well 6 be located on a line between injection well 2 and production well 3, and may be offset in either direction from a straight line arrangement. One convenient location of infill well 6 is in alignment with wells 2 and 3, however. Similarly, it is not essential that well 6 be located exactly midway between injection well 2 and production well 3, and it is adequate for our purposes if the distance between injection well 2 and infill well 6 is from 25 to 75 percent and preferably from 40 to 60 percent of the distance between injection well 2 and production well 3. Infill well 6 is perforated or other fluid flow communication is established between well 6 and the formation, only in the lower 50 percent and preferably the lower 25 percent of the formation which is a zone of the formation which has not yet been swept by steam. This is essential to the proper functioning of our process.

It is immaterial for the purpose of practicing our process, whether infill well 6 is drilled and completed at the same time as injection well 2 and production well 3, and/or if such drilling and completion of infill well 6 is deferred until steam breakthrough has occurred at production well 3, or at some intermediate time. If completed prior to use, infill well 6 is simply shut in during the first phase of the process of our invention.

The fluid injected into injection well 2 during all of the steps described herein, as well as that injected into infill well 6 in the subsequent portion of the process of our invention, will comprise steam or a mixture of steam and a hydrocarbon solvent, such as hydrocarbons in the range of $C_1$ to $C_{10}$, as well as kerosene, naphtha, natural gasoline, etc. Hydrocarbon condensate from the vapor phase portion of fluids being produced in a steam drive oil recovery process, especially one being applied to the same oil zone, is a particularly desirable hydrocarbon for use in our process. The hydrocarbon may be mixed with steam being injected into the infill well in which the hydrocarbon content of the injection fluid is from 0.10 to 20 and perferably from 1.0 to 5.0 percent by weight. One or more slugs of hydrocarbon may be injected before and/or intermittently with steam if more convenient, in which case the slug size and frequency of injection is selected to maintain the average hydrocarbon content of the injected fluid within the above described limits. So long as the fluid injected into injection well 2 comprises a major portion of vapor phase steam, the problem of steam channeling will be experienced in the steam drive process no matter what hydrocarbons are comingled with the injected steam, and the process of our invention may be incorporated into the steam drive oil recovery process with the resultant improvement in vertical conformance.

Turning again to the drawings, our invention in its broadest aspect comprises a minimum of four steps to be applied to an oil formation. FIG. 2 illustrates a minimum three-well unit for employing the process of our invention, wherein formation 1 is penetrated by an injection well 2 which is in fluid communication with essentially all of the vertical thickness of the formation. Spaced-apart production well 3 is a conventional production well, which is also in fluid communication with essentially all of the vertical thickness of the formation. Infill well 6 is shown located about midpoint between well 2 and 3, and within the recovery zone defined by wells 2 and 3, i.e. on or adjacent to a line between wells 2 and 3, and fluid communication is established between well 6 and the lower portion of the formation, in this instance being something less than 50 percent of the total thickness of the formation.

In the first step, a thermal recovery fluid comprising steam or a mixture of steam and hydrocarbon solvent is injected into the formation by means of injection well 2 of FIG. 2. Steam and hydrocarbons enter the portion of the formation immediately adjacent to well 2 through all of the perforations in well 2, and initially travels through substantially all of the full vertical thickness of formation 1. Because the specific gravity of vapor phase steam is significantly less than the specific gravity of other fluids, including the viscous petroleum present in the pore spaces of formation 1, steam vapors migrate in an upward direction due to gravitational effects, and as can be seen in FIG. 1, the portion 4 of the formation 1 swept by steam vapors in the first step represents an ever decreasing portion of the vertical thickness of the formation as the steam travels between the injection well and production well 3. Hydrocarbon solvent invades the unswept portions of the formation, aiding in stripping oil therefrom, and so the presence of hydrocarbons in the steam improves the ultimate vertical conformance somewhat as will be explained more fully below. Nevertheless, by the time steam and hydrocarbons arrive at production well 3, only a small fraction of the full vertical thickness of the formation is being contacted by the injected fluid. Oil is recovered from the portion of the formation through which the steam vapors travel, although the total recovery from the recovery zone defined by wells 2 and 3 will usually be significantly less than 50 percent of the total amount of petroleum in the recovery zone. Even though more than 50 percent of the oil originally present in portion 4 of the formation is swept by steam, the large amount of oil unrecovered from that portion 5 through which very little of the steam passes causes the total recovery efficiency to be very low. The recovery efficiency as a consequence of this problem is influenced by the thickness of the formation, the well spacing, the viscosity of the petroleum present in the formation at initial conditions, as well as by other factors. Recoveries substantially below 50 percent are not uncommon in field application of steam hydrocarbon drive processes.

FIG. 2 illustrates how the infill well is positioned between the injection well and the production well, and as stated above it is immaterial to the process of our invention whether the well is drilled and completed at the same time wells 2 and 3 are drilled and completed, or whether either the drilling or the completion or both are deferred until infill well 6 is needed.

The first step comprising injecting steam and hydrocarbons into injection well 2 and recovering fluids from the formation by means of production well 3 continues until steam or steam condensate production at well 3 is detected. The preferred method comprises continuing this step until live steam production occurs at well 3. Once steam is being produced in well 3, further production of oil will be at a much diminished rate, since the only mechanism by means of which additional oil can be recovered from the formation below the steam-swept zone 4 will be by a stripping action, in which oil is recovered along the surface 7 between the steam-swept portion 4 of the formation and portion 5 of the recovery zone through which steam has not passed. Although this mechanism may be continued for very long periods of time and oil can be recovered from zone 5 by this means, the stripping action is extremely inefficient and it is not an economically feasible means of recovering viscous oil from the formation after steam breakthrough occurs at well 3.

Figure 3:
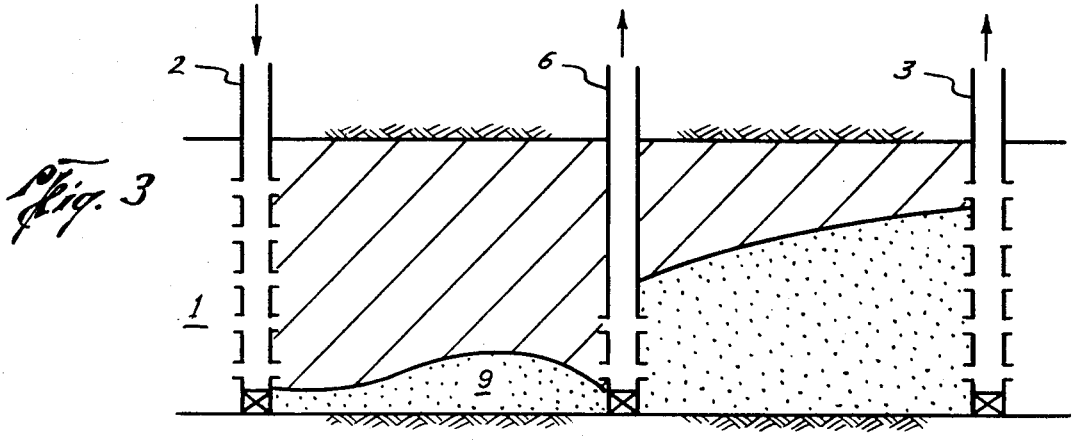
FIG. 3 illustrates the state of the formation at the conclusion of the foregoing step, before solvent and steam injection into the infill well has begun, illustrating the additional portion of the formation swept at that stage of the process.

In the second step in the process of our invention, infill well 6 is utilized as a production well. Steam and hydrocarbon injection into the injection well 2 is continued in essentially the same manner as in the first step. It should be understood that a significant amount of oil is recovered from the formation by this step alone which is not recovered at the economic conclusion of the first step. It has been found that the oil saturation in zone 8, that being the portion of the recovery zone between the infill well and injection well 2, occupying the lower thickness of the formation, is actually increased during the period of recovering oil from swept zone 4 in FIG. 1. This is caused by migration of oil mobilized by injected steam, into the portion of the formation through which steam does not travel during this first period. Thus, if the average oil saturation throughout viscous oil formation 1 is in the range of about 55 percent (based on the pore volume), injection of steam into the formation may reduce the average oil saturation throughout depleted zone 4 to 15 percent, but the oil saturation in zone 8 will increase to a value from 60 to 70 percent. The second step in the process of our invention, in which fluids are recovered from infill well 6, accomplishes steam stimulated recovery of petroleum from zone 8 in the drawing which is not recoverable by processes taught in the prior art. Because fluid communication only exists between well 6 and the lower portion of the formation, no more than the lower 50 percent and preferably the lower 25 percent or less of the formation, movement of oil into these perforations results in sweeping a portion of the formation not otherwise swept by steam. In FIG. 3, it can be seen that a portion 9 still remains unswept by the injected steam, but it is significantly less than the volume of zone 8 prior to application of the second step of the process of our invention. Once the water cut of the fluid being produced from the formation by means of well 6 increases to a predetermined value, preferably at least 95 percent, production of fluids from the formation by means of well 6 is terminated and well 6 is converted to an injection well.

During the above described second step of the process of our invention, steam injection into well 2 must be continued, and production of fluids from well 3 may be continued at the original or at a descreased rate, or it may be discontinued altogether depending on the water cut of fluid being produced at that time.

Figure 4:
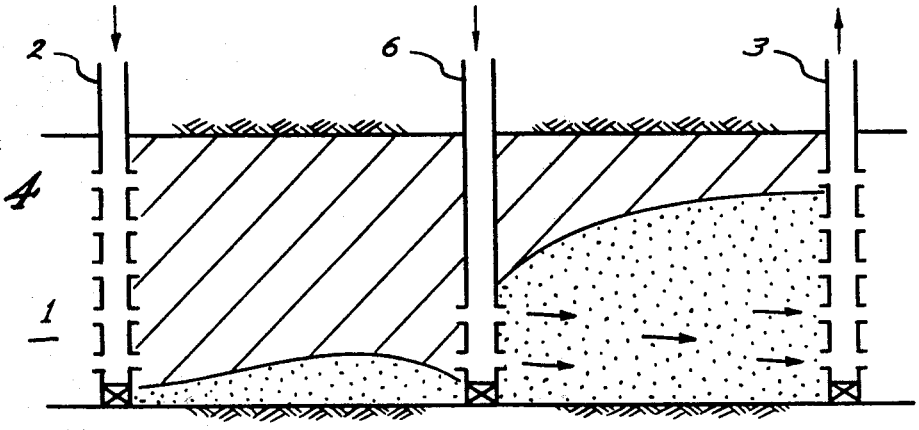
FIG. 4 illustrates the portion of the process of our invention in which hot water injection is being applied to the formation by means of the infill well, illustrating how water passes through the lower portion of the recovery zone in the formation between the infill well and the production well.

After conversion of infill well 6 from a producing well to an injection well, a preferred embodiment comprises injecting hot water into well 6 and taking fluid production from well 3. It is essential that the fluid being injected into well 6 be substantially all in the liquid phase during this step of the process of our invention. The reason the fluid must be substantially all liquid phase is that gravity forces must be relied on to ensure that the injected fluid travels in the lower portion of that zone of the recovery zone between infill well 6 and production well 3. This can be seen in FIG. 4, wherein the injected liquid travels principally through the lower portion of the section of the formation between infill well 6 and production well 3. During this step, production of fluids must be taken from well 3, and continued injection of steam into well 2 is optional. Because the specific gravity of liquid phase water is substantially greater than the specific gravity of vapor phase steam, the fluids are confined to the lower flow channels within the formation, and thus travel through a portion of the formation not contacted by vapor phase steam during the previous steps. Hot water mobilizes viscous petroleum, although it is less effective than steam. Hot water injection will, however, reduce the oil saturation in the lower portion of the zone between infill well 6 and production well 3, and will therefore increase the permeability of that portion of the recovery zone. Hot water injection is continued until the water cut of the fluid being produced from well 3 rises to a value greater than about 80 percent and preferably greater than a value of about 95 percent. This ensures the optimum desaturation of the lower portion of the zone between infill well 6 and production well 3 which is necessary to increase the permeability of that section of the recovery zone sufficiently that the next phase of the process can be successful.

In a slightly different preferred embodiment of the process of our invention, the fluid being injected into well 6 in the foregoing steps comprises a mixture of hot liquid phase water and hydrocarbons. In this embodiment, it is preferred that the hydrocarbon be in the liquid phase to ensure that it travels through substantially the same flow channels as the liquid phase water, and so the boiling point of the hydrocarbons should be above the temperature of the hot water being injected into the formation. One especially preferred hydrocaron for this purpose comprises the hydrocarbons being recovered from produced vapors along with oil in a steam drive stimulation process in the same or other zones in the formation, which hydrocarbons were separated from oil in the formation as a consequence of steam distillation. This appears to be an optimum hydrocarbon for this purpose, due at least in part to the fact that the material is necessarily fully miscible with the formation petroleum, having been obtained therefrom by steam distillation.

Figure 5:
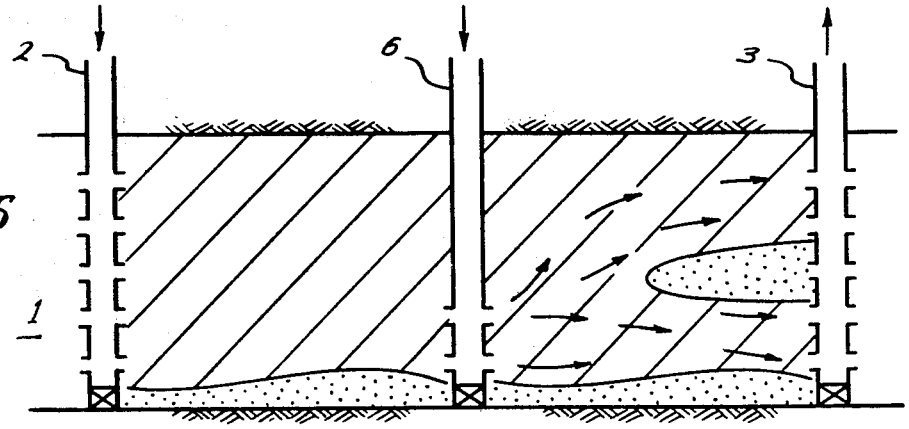
FIG. 5 illustrates the next step of the process of our invention in which steam and hydrocarbons are injected into the infill well, passing through both the lower as well as upper portions of the recovery zone between the infill well and the production well.

After the water cut of fluids being produced from well 3 during this phase of the process of our invention reaches the above-described levels, injection of liquid phase water into infill well 6 is terminated and steam and hydrocarbon injection into infill well 6 is thereafter initiated. The step of injecting all liquid phase hot water into the infill well prior to injecting steam is an optional but highly desirable variation of the process. The passage of hot water through the lower portion of the formation between infill well 6 and producing well 3, causes at least a portion of the steam and hydrocarbon injected later into infill well 6 to pass through the lower portion of the formation as is illustrated in FIG. 5. It must be appreciated that steam would not travel through the lower portion of the formation under these conditions if hot water had not first been injected for the purpose of desaturating the lower portion of the zone between wells 6 and 3, which established a zone of increased permeability, thereby ensuring that the flow channel permeability is sufficient so at least a portion of the steam will pass through the lower portions of the formation. This will result in some steam underriding the residual oil in the portion of the zone between wells 6 and 3, although a degree of steam override may be encountered in this portion of the process as communication between the point where steam is entering the formation through perforations in well 6 and previously depleted zone 4 occurs. Steam and hydrocarbon injection is continued, and the oil production rate is significantly better as a result of the previous formation of flow channels in the lower portion of the formation, since the stripping action is more efficient with respect to overlying oil saturated intervals than it is with respect to an underlying oil saturated interval. The reasons for this involve the fact that oil mobilized by thermal contact with the fluid passing under an oil saturated interval drains downward by gravitational forces into the flow channel, and also because steam movement occurs in an upward direction into the oil-saturated interval more readily than downward, also due to gravitational forces.

In the above described step of injecting steam and hydrocarbons into the infill well, the remarks concerning the amount, kind and method of injecting hydrocarbons with steam described above for injecting into the primary injection well, apply equally to injection of steam and hydrocarbons into the infill well.

The above described fourth step is continued with steam being injected into infill well 6 and fluid production being taken from well 3, until steam or steam condensate production at well 3 occurs to a predetermined extent. This step is preferably continued until the water cut of fluids being taken from the formation by well 3 reaches a value greater than 80 percent and preferably at least 95 percent. Continued injection (steam or water) into well 2 during this step is necessary to provide a pressure gradient and retard fluid movement from well 6 toward well 2. The desired pressure gradient will be maintained if the rate of injecting steam or hot water into the injection well is greater than, and preferably at least twice the value of, the rate of injecting steam into the infill well.

Figure 6:
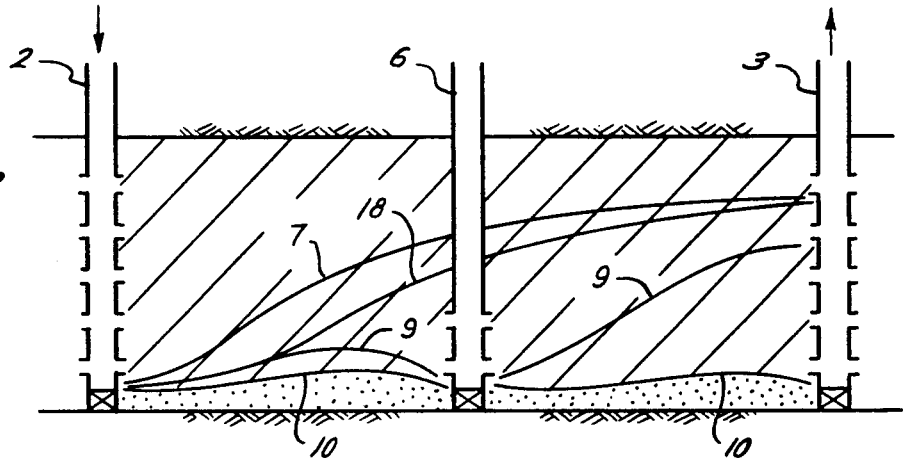
FIG. 6 illustrates typical locations of the interfaces between swept and unswept portions of the formation in four processes: the case of conventional steam, steam plus use of infill well, steam plus hydrocarbon, and steam plus hydrocarbon process of our invention using infill well for both oil production and for steam plus hydrocarbon injection.
Figure 7:
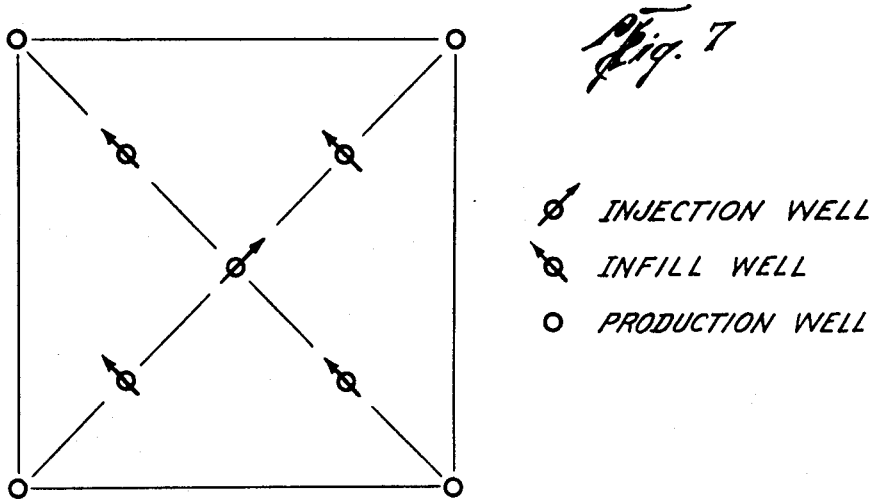
FIG. 7 illustrates in plan view how the process of our invention may be applied to a conventional five-spot pattern with infill wells located between a central injection well and corner production wells.

The effectiveness of this process relative to other processes is illustrated in FIG. 6, wherein the boundaries between the swept and unswept portions of the recovery zone between wells 2 and 3 for four basic processes is given, as follows. Curve 7 illustrates the boundary for a conventional steam drive process not employing use of an infill well. Curve 18 illustrates the improvement attained when hydrocarbon solvent is comingled with steam in a conventional steam drive process, but again without use of the infill well. Curve 9 illustrates the improvement attained when steam drive recovery is augmented by use of an infill well, first for oil recovery and then for steam injection. Curve 10 shows the greatly improved condition resulting from application of the process of our invention, wherein hydrocarbon solvent is comingled with steam and an infill well is employed first for oil production and then for hot water injection followed by steam and hydrocarbon injection.

A variation of the above described process is especially suitable for formations having very high viscosity oil, i.e. those formations which contain petroleum whose API gravity is less than 15 and especially those containing petroleum less than 10° API. This preferred embodiment involves one additional step, which occurs prior to the injection of hot water or steam and hydrocarbon into infill well 6. In this embodiment, after fluid production from infill well 6 has been terminated and infill well 6 has been converted to an injection well, cold water is the first fluid injected into infill well 6. For the purpose of this process, by "cold water", it is meant water whose temperature is less than 160° and preferably less than 80° F. Ordinarily, it is sufficient to inject water at surface ambient conditions. The passage of cold water into portions of the formation immediately adjacent to the perforations in infill well 6 causes the condensation and collapse of the steam vapor occupying the pore spaces of portions of the formation, increasing the liquid water saturation of that portion of the formation, and therefore decreases the permeability of the portion of the formation in which steam condensation has occurred. This further encourages the passage of the subsequently-injected hot water into the lower flow channels in the portion of the recovery zone between well 6 and well 3.

EXPERIMENTAL EVALUATION

For the purpose of demonstrating the magnitude of the improvement in vertical conformance achieved from application of the infill well concept employed in the preferred embodiments of our invention, the following laboratory experiments were performed.

A laboratory cell was constructed, the cell being 3 inches wide, 8½ inches high and 18½ inches long. The cell is equipped with three wells, an injection well and production well in fluid communication with the full height of the cell and a central infill well which is in fluid communication with lower 15 percent of the cell, the well arrangement being similar to that shown in FIG. 2. A base steam drive flood was conducted in the cell to demonstrate the magnitude of the steam override condition. The cell was first packed with sand and saturated with 14 degree API gravity crude to initial oil saturation of 53.0 percent. The infill well was not used in the first run, this run being used to simulate a conventional throughput process according to the steam drive processes described in the prior art. After steam injection into the injection well and fluid production from the production well continued to a normal economic limit, the average residual oil saturation in the cell was 46.3 percent. In the second run, the infill well was employed in the steam drive run with steam being injected into the injection well and oil production taken from the production well until live steam breakthrough was detected at the production well, followed by oil production from the infill well, followed by first injecting cold water, then hot water and then steam into the cell by means of the infill well and recovering fluid from the producing well to a water cut of 98 percent. The overall residual oil saturation at the conclusion of this run was 30.1 percent compared with the initial oil saturation of 53 percent in both cases. It can be seen that the base flood recovered only 12.6 percent of the oil present in the cell whereas application of the process of our invention resulted in recovering 43 percent of the oil, or about 3.4 times as much oil as the base run.

Thus we have disclosed and demonstrated in laboratory experiments how significantly more viscous oil may be recovered from an oil formation by a throughput, steam drive process by employing the process of our invention with infill wells located between injection and production wells, and a multi-step process as described above. While our invention is described in terms of a number of illustrative embodiments, it is clearly not so limited since many variations of this process will be apparent to persons skilled in the art of viscous oil recovery methods without departing from the true spirit and scope of our invention. Similarly, while mechanisms have been discussed in the foregoing description of the process of our invention, these are offered only for the purpose of complete disclosure and is not our desire to be bound by or restricted to any particular theory of operation of the process of our invention. It is our desire and intention that our invention be limited and restricted only by those limitations and restrictions appearing in the claims appended immediately hereinafter below.

We claim:

1. A method of recovering viscous oil from a subterranean, viscous oil containing formation, said formation being penetrated by at least three wells, one injection well and one production well, both of said injection and production wells being in fluid communication with a substantial portion of the formation, and an infill well located between the injection well and production well in fluid communication with only the lower 50 percent of the formation and located within the recovery zone defined by the injection and production wells, comprising:

(a) injecting a thermal oil recovery fluid comprising steam into the injection well and recovering fluid including oil from the formation by the production well until the fluid being recovered from the production well comprises a predetermined amount of steam or water;

(b) thereafter recovering fluids including oil from the formation by the infill well until the fluid being recovered comprises a predetermined fraction of steam or water;

(c) injecting steam into the infill well and recovering fluids from the formation via the production well, and simultaneously injecting an aqueous fluid into the injection well at a rate sufficient to ensure maintenance of a positive pressure gradient between the injection well and infill well;

(d) injecting an effective amount of a hydrocarbon into the infill well sequentially or simultaneously with steam injection;

(e) continuing injecting steam or steam and hydrocarbon into the infill well and recovering fluids including oil from the formation via the production well until the water cut of the produced fluids is at least 80 percent.

2. A method as recited in claim 1 comprising the additional step of injecting hot water into the formation via the infill well between the step of recovering fluids from the formation by the infill well and the step of injecting steam into the formation via the infill well.

3. A method as recited in claim 2 wherein hot water injection into the infill well is continued until the percentage of water in the fluid being recovered from the formation via the production well rises to a value of at least 95 percent.

4. A method as recited in claim 2 comprising the additional step of injecting a liquid hydrocarbon solvent into the infill well simultaneously or comingled with or alternately with the hot water.

5. A method as recited in claim 4 wherein the boiling point of the hydrocarbon is less than the temperature of the hot water being injected into the infill well.

6. A method as recited in claim 1 comprising the additional step of injecting water whose temperature is less than 160° F. into the formation via the infill well prior to injecting steam into the infill well.

7. A method as recited in claim 6 wherein the temperature of the water is less than 80° F.

8. A method as recited in claim 1 wherein steam injection into the formation according to step (a) is continued until vapor phase steam production occurs at the production well.

9. A method as recited in claim 1 wherein the production of fluids from the formation by the infill well according to step (b) is continued until the percentage of water of said fluids rises to a value of at least 80 percent.

10. A method as recited in claim 9 wherein fluid production is continued until the water content reaches 95 percent.

11. A method as recited in claim 1 wherein the step of injecting steam into the infill well as defined in step (c) is continued until the fluid being recovered from the formation is at least 95 percent water.

12. A method as recited in claim 1 wherein the thermal fluid injected into the formation in step (a) comprises a mixture of steam and hydrocarbon.

13. A method as recited in claim 12 wherein the hydrocarbon comprises $C_1$ to $C_{10}$ hydrocarbons.

14. A method as recited in claim 12 wherein the hydrocarbon is kerosene, naphtha, natural gasoline, condensed hydrocarbons from the fluids being produced in a steam drive oil recovery process, or mixtures thereof.

15. A method as recited in claim 1 wherein the hydrocarbon of step (d) is a $C_1$ to $C_{10}$ hydrocarbon.

16. A method as recited in claim 15 wherein the hydrocarbon is a $C_3$ to $C_7$ hydrocarbon.

17. A method as recited in claim 1 wherein the hydrocarbon is kerosene, naphtha, natural gasoline, condensed hydrocarbons from the fluids being produced in a steam drive oil recovery process, or mixtures thereof.

18. A method as recited in claim 1 wherein the hydrocarbon injected in step (d) is injected in a series of discrete slugs of from 0.001 to 0.05 pore volumes interspersed between slugs of steam.

19. A method as recited in claim 1 wherein the hydrocarbon injected in step (d) is comingled with steam.

20. A method as recited in claim 19 wherein the amount of hydrocarbon comingled with steam is from 0.05 to 20 percent by weight.

21. A method as recited in claim 20 wherein the percent hydrocarbon is from 1.0 to 5.0.

* * * * *